US009986826B1

(12) United States Patent
Melia

(10) Patent No.: US 9,986,826 B1
(45) Date of Patent: Jun. 5, 2018

(54) HIDDEN STORAGE DEVICE FOR SAFELY STORING MEDICATIONS AND SEPARATING DAILY DOSAGES

(71) Applicant: Geraldine Melia, Boca Raton, FL (US)

(72) Inventor: Geraldine Melia, Boca Raton, FL (US)

( * ) Notice: Subject to any disclaimer, the term of this patent is extended or adjusted under 35 U.S.C. 154(b) by 0 days. days.

(21) Appl. No.: 15/203,112

(22) Filed: Jul. 6, 2016

Related U.S. Application Data

(60) Provisional application No. 62/199,552, filed on Jul. 31, 2015.

(51) Int. Cl.

| | |
|---|---|
| ***A61J 7/00*** | (2006.01) |
| ***A61J 7/04*** | (2006.01) |
| ***A47B 67/02*** | (2006.01) |
| ***A47B 67/00*** | (2006.01) |
| ***A47B 96/20*** | (2006.01) |

(52) U.S. Cl.
CPC ..... *A47B 67/02* (2013.01); *A47B 67/005* (2013.01); *A47B 96/20* (2013.01); *A61J 7/04* (2013.01); *A47B 2067/025* (2013.01); *A47B 2096/207* (2013.01)

(58) Field of Classification Search
CPC ..... A47B 67/00; A47B 67/02; A47B 67/005; A47B 96/20; A47B 2096/207; A47B 2067/025; A61J 7/04
See application file for complete search history.

(56) References Cited

U.S. PATENT DOCUMENTS

| | | | | | |
|---|---|---|---|---|---|
| 3,259,445 | A | * | 7/1966 | Saxon | A47B 77/16 211/75 |
| 3,703,955 | A | * | 11/1972 | Inacker | B65D 83/0445 206/532 |
| 3,744,867 | A | * | 7/1973 | Shaw | A61J 7/04 116/308 |
| 3,802,600 | A | * | 4/1974 | Shaw | A61J 7/04 221/5 |
| 4,070,074 | A | * | 1/1978 | Rohme | E05D 3/022 109/70 |
| D262,761 | S | * | 1/1982 | Young | D6/561 |
| 4,573,580 | A | * | 3/1986 | Messer | A61J 7/04 206/459.1 |
| 4,707,204 | A | * | 11/1987 | Heeg | A47B 96/201 144/347 |
| 4,749,085 | A | * | 6/1988 | Denney | B65D 25/103 206/459.5 |
| 5,139,322 | A | | 8/1992 | Aisley | |

(Continued)

*Primary Examiner* — Daniel J Troy
*Assistant Examiner* — Kimberley S Wright
(74) *Attorney, Agent, or Firm* — Daniel S. Polley, P.A.

(57) ABSTRACT

A hidden storage device for preferably safely storing, hiding and separating medications. The device is secured to a wall of a room and has a decorative element or mirror secured to an external surface of a door. Therefore, to a viewer the device appears to be a decorative object or mirror hanging from a wall with the storage area hidden. A plurality of drawers preferably numbered for each day of the month. The user separates his or her daily medication in each drawer. Each drawer can be divided and labeled into multiple sections to permit the user to further separate the daily medications into morning dosages and evening dosages. A lock can also be provided for locking the door in a closed position. One of the drawers can also be labeled with refill indicia to reminder the user to refill each drawer.

18 Claims, 8 Drawing Sheets

(56) References Cited

U.S. PATENT DOCUMENTS 5,267,786 A * 12/1993 Aisley ..... A47B 67/02 248/468
5,558,229 A * 9/1996 Halbich ..... A61J 7/04 206/499
5,690,404 A 11/1997 Keller
5,905,653 A * 5/1999 Higham ..... G07F 17/0092 312/215
6,053,585 A * 4/2000 Osen ..... A47B 96/201 312/204
6,068,357 A 5/2000 Keller
6,089,685 A * 7/2000 Ryan ..... A47B 57/10 312/291
6,338,535 B1 * 1/2002 Rickert ..... A61J 7/0084 312/234.1
6,357,843 B1 3/2002 Keller
D460,254 S * 7/2002 Rufo ..... D3/203.3
6,733,095 B1 * 5/2004 Rieb ..... A47B 46/00 312/122
7,207,636 B2 * 4/2007 Livingston ..... A47B 47/0091 312/265.6
7,387,151 B1 * 6/2008 Payne ..... E06B 5/006 160/371
8,132,672 B2 * 3/2012 Ganti ..... B65D 83/04 206/539
D660,583 S * 5/2012 Mlinarevic ..... D3/203.3
8,272,702 B2 9/2012 Brink
8,554,365 B2 * 10/2013 Thomas ..... G06F 19/3462 700/236
9,579,263 B2 * 2/2017 Ababio ..... A61J 7/0076
2003/0042828 A1 * 3/2003 Bonin ..... A47B 67/02 312/245
2003/0090364 A1 * 5/2003 Cardinale ..... E05B 43/005 340/5.54
2004/0206659 A1 * 10/2004 Hennig ..... A47B 67/02 206/570
2005/0073224 A1 * 4/2005 Livingston ..... A47B 47/0091 312/265.6
2006/0119235 A1 * 6/2006 Aisley ..... A47B 47/00 312/242
2008/0042531 A1 * 2/2008 Livingston ..... A47B 47/0091 312/204
2008/0111454 A1 * 5/2008 Spoljaric ..... A61F 17/00 312/209
2009/0015121 A1 1/2009 Sampson
2010/0206765 A1 * 8/2010 Fonte ..... A61J 7/04 206/534
2011/0186470 A1 * 8/2011 Ganti ..... B65D 83/04 206/538
2012/0200211 A1 * 8/2012 Yanni ..... A47B 67/00 312/242
2012/0209763 A1 * 8/2012 Zabbatino ..... G06Q 30/0645 705/39
2014/0021083 A1 * 1/2014 Liu ..... A61J 1/00 206/438
2016/0081881 A1 * 3/2016 Ababio ..... A61J 7/0076 362/23.01

* cited by examiner

HIDDEN STORAGE DEVICE FOR SAFELY STORING MEDICATIONS AND SEPARATING DAILY DOSAGES

This application claims the benefit of and priority to U.S. Application Ser. No. 62/199,552, filed Jul. 31, 2015, which application is incorporated by reference in its entirety for all purposes.

1. FIELD OF THE DISCLOSURE

This application is related generally to the storage of medical prescription and in particular to devices for safely storing medical prescriptions.

2. BACKGROUND

Medicine cabinets are widely used in residential areas for storing medicines, and various other articles. They are often rectangular and have a shallow depth. The depth allows them to be mounted to an outer surface or be recessively mounted within the surface. Usually the medicine cabinet is provided with a hinged door. Shelving is usually provided within the medicine cabinet body. Medicine cabinets are known for use in storing medicines and toiletries, etc.

Typically, medications stored in a medicine cabinet are accessible by anyone in the home, including small children and potential thieves. Children, who are naturally curious, may gain possession of medications stored in a medicine cabinet and ingest a harmful substance which could result in sickness or death to the child. Additionally, visitors who could be potential drug medication thieves may also have easy access to the medications contained in the medicine cabinet. Certain medications have high street value and could be attractive to a thief if discovered in a medicine cabinet. Theft of medications, which are often expensive to replace, may deny the prescribed person the use of such medications, leading to a potentially harmful situation. There are many incidences of medicine cabinet drug misuse by unauthorized access to such medicine cabinets and many other related safety problems relating to storing medicines in traditional medicine cabinets.

It is to addressing or at least reducing one or more of the above problems that the disclosed novel Rx prescription safety locker is directed.

SUMMARY OF THE DISCLOSURE

Disclosed is a novel hidden storage device primarily intended for safely storing medications though such is not considered limiting. The storage device can comprises a body or frame having a plurality of rows for receipt of a plurality of drawers. Preferably, at least 31 drawers are provided, such that each day of the month can be represented and used for placing daily medications in each drawer for the month. Additionally, each drawer can be divided into preferably two sections, and one preferably label "AM" for morning medications and the other section preferably labeled "PM" for evening medications. A preferably hinged door can be conventionally secured to the frame. In a closed position, the door prevents access to the drawers housed within the frame and in an open position the door permits access to the drawers and the medications contained therein.

The novel storage device is preferably attached in an unconventional location within a dwelling as compared to where a medicine cabinet is normally found (i.e. on the bathroom wall by a sink). Given its preferable unconventional attachment location, the outer surface of the door can be provided with a decorative element (i.e. painting, photograph, etc.) or a mirror. Preferably, the hidden storage device is secured to a inside wall of a dwelling, such as, but not limited to, a living room or bedroom. Thus, with the door in a closed position, when the storage device is attached to the wall, the storage device appears as an embossed mirror, painting, photograph, etc. and doesn't appear to be a medicine cabinet or other type of storage device.

To further secure the contents contained within the frame (i.e. medicine in the drawers, medicine or other items resting on one of the rows of shelves, etc.) a lock can be provided for locking the door in the closed position. Preferably, the door extends beyond the border of the frame such that access to the lock can be located behind the door. Therefore, when viewed from the front, the viewer merely sees the decorative element or mirror and does not see the lock.

Thus, in use, the storage device provides for an easy accessible storage device, preferably for medications, which can be locked in a closed position and which can be hidden behind a decorative element appearing to be a conventional decorative secured to a wall within the dwelling.

The disclosed novel storage device preferably provides for a safety drug or medicine storage assembly with a designed/decorative door/cover and lock member (i.e. key, combination, code, biometric, etc.). The lock can be in communication with an alarm member and/or can also be locked by a remote with an alarm. A plurality of drawers are preferably provided for the storage of medicine for at least an entire month. The decoration/design of the outer/external side of the door preferably camouflages or otherwise hides (i.e. when the door is closed) the storage portion of the device while the device is secured to a wall. The device can be secured to the wall by and conventional means.

Preferably, at least some of the drawers contained within the storage area can be split AM/PM drawers preferably numbered from one to thirty one representing the days of a month. In each drawer would be stored medicine for each day for the entire month, and preferably separated in each drawer by morning medications (AM) and evening medications (PM).

The shelves or rows of shelves within the storage area can be adjustable or permanently secured to the frame/body of the storage area. Medicine bottles and other objects can be stored on the shelves, though the disclosure is not considered limited to any particular item being stored or housed by the storage device or resting on a shelf. Furthermore, additional drawers, beyond the preferred 31 drawers for each day of the month, can also be provided for storing other medical necessities and/or items, though again, the disclosure is not limited to any particular object being stored within the storage device. A reminder message or indication can also be provided to remind the user to refill the medicine in the drawers or reorder medication, which can be preferably provided a specific period of time during a current month.

In one non-limiting embodiment, the main body/frame of the storage device can be constructions from a plastic or metal material, though other materials can be used and are considered within the scope of the disclosure. The body/frame (without the door secured) define a forwardly open storage body adapted for installation into or securement/attachment the wall of a building.

Accordingly, the disclosed novel wall mounted storage device provides for a location for safekeeping/storing medications and/or other valuable or items, while concealing the contents of the items contained inside the storage device through its decorative or mirrored access door.

Other features and advantages of the disclosed novel storage device will become more apparent from the following detailed description, taken in conjunction with the accompanying drawings, and are also considered within the scope of the disclosure.

DETAILED DESCRIPTION

Figure 1:
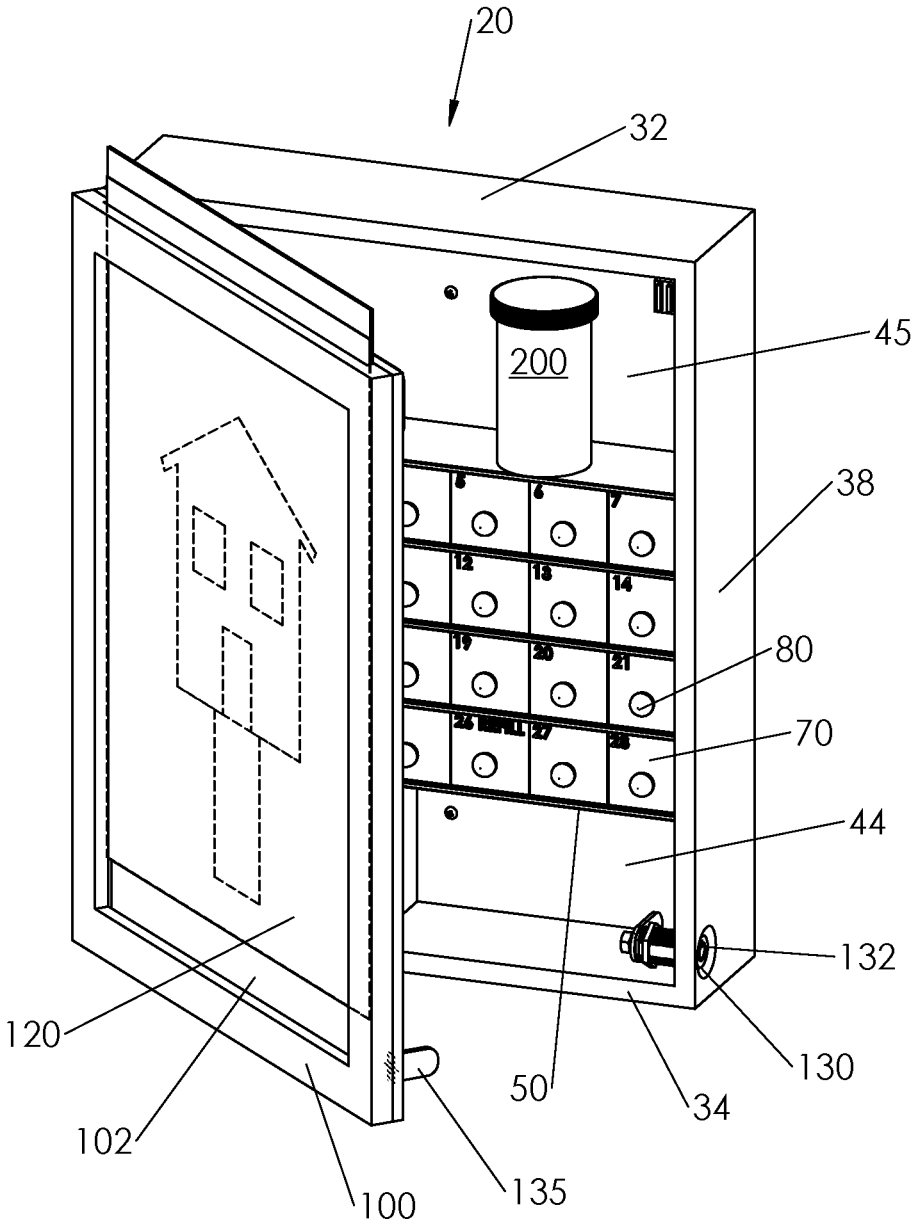
FIG. 1 is a front perspective view of the novel storage device in accordance with the current disclosure.
Figure 2:
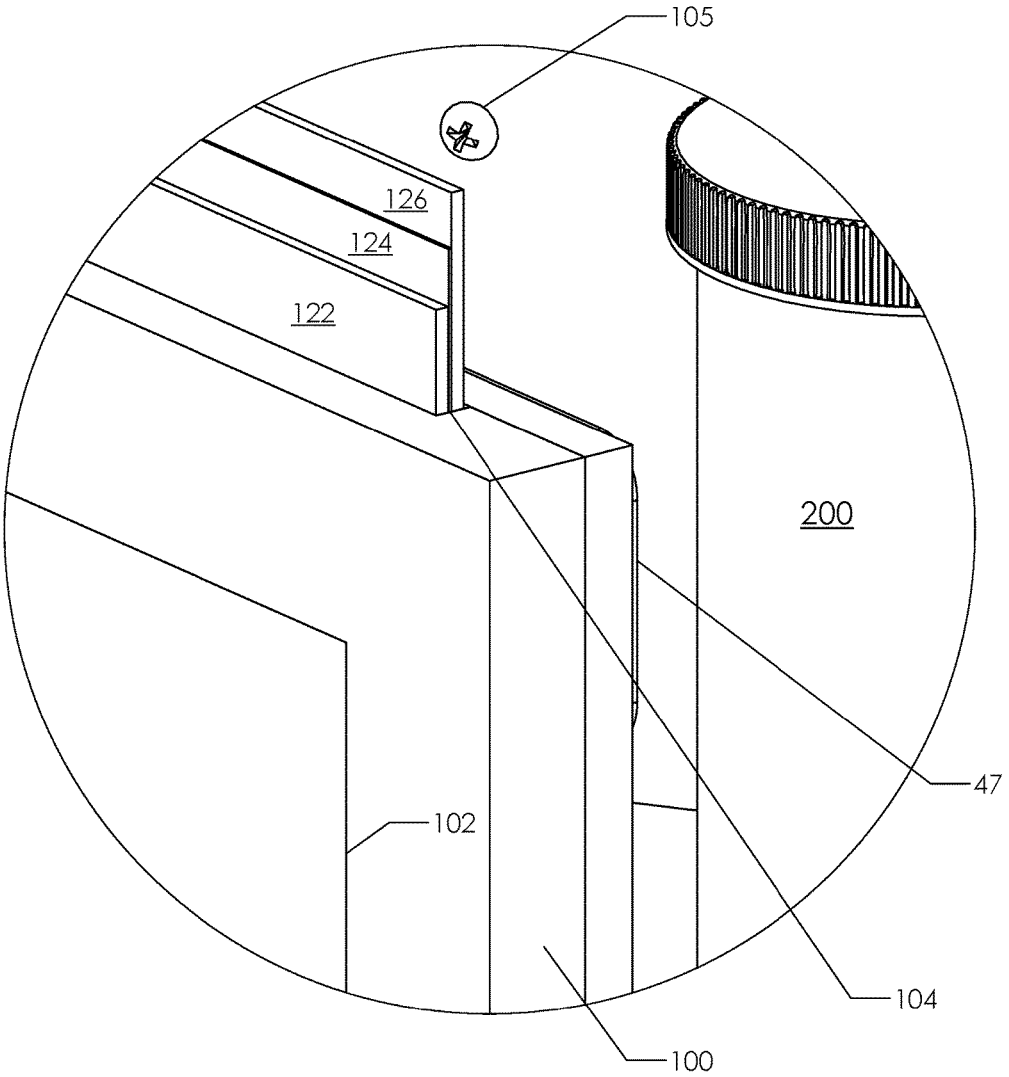
FIG. 2 is a close up view of a top portion of the door for the novel storage device of FIG. 1 and illustrating one non-limiting design for providing a decorative element or mirror at the external side of the door.

As seen in the Figures, a hidden storage device for safely storing medications and separating medications into daily dosages is shown and generally designated as storage device 20. Storage device 20 includes a frame or body member 30 which can be preferably rectangular or square shaped. Frame 30 includes a top wall 32, a bottom wall 34, first side wall 36, second side wall 38 and back wall 40. The walls of frame 30 can be monolithically formed or constructed integral such that they remain permanently secured to each other. The walls define an internal storage area 42.

One or more, and preferably a plurality, of shelves 50 can be disposed within storage area 42. Shelves 50 can be permanently secured to first side wall 36 and second side wall 38 and/or back wall 40 by conventional means. Additionally, by providing a series of ledges on an inner surface of side walls 36 and 38, shelves 50 can also be adjustably/removably secured to side walls 38 and 38 and within storage area 42. Preferably, whether permanently or adjustably secured within storage 42, shelves 50 can be spaced apart sufficiently to allow a plurality of drawers 70 to be inserted into storage area and rest on one of the shelves 50.

Figure 3:
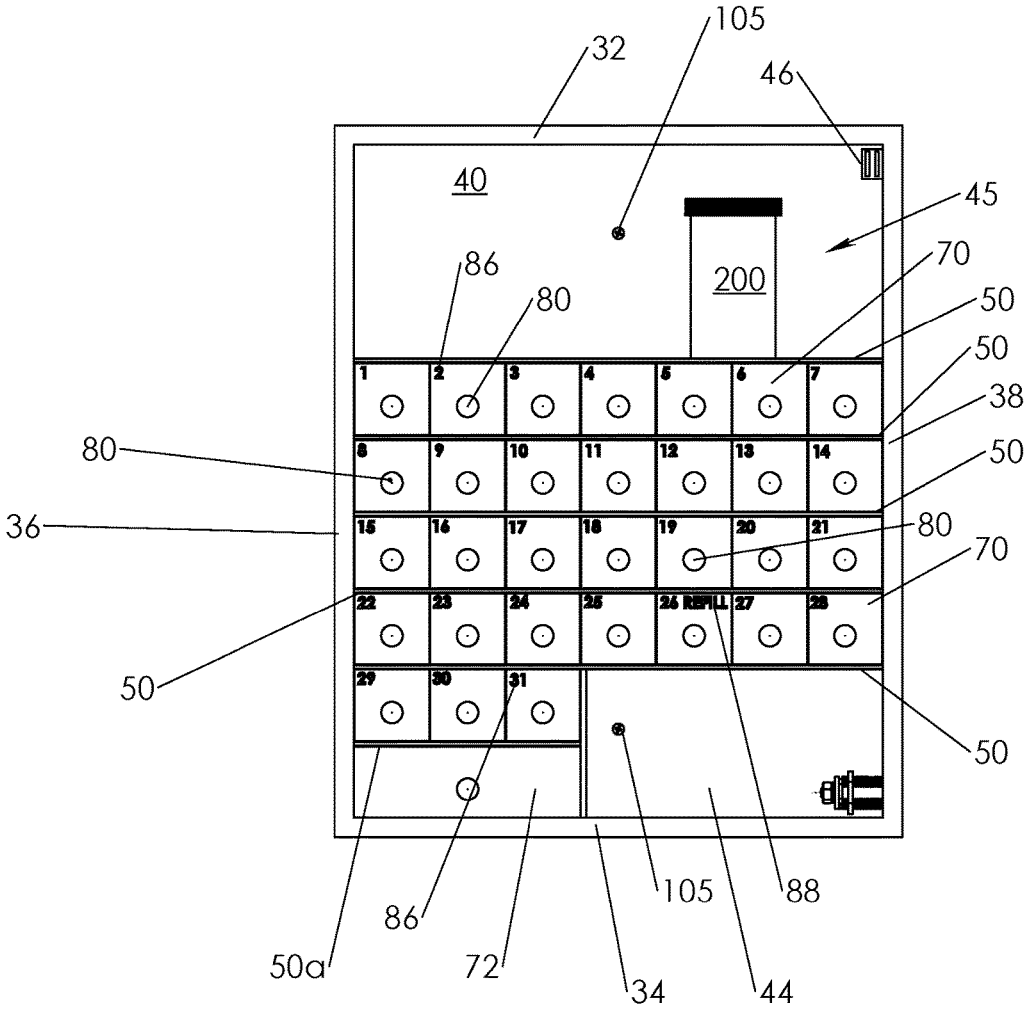
FIG. 3 is a front view of the novel storage device of FIG. 1 with the door removed.
Figure 4:
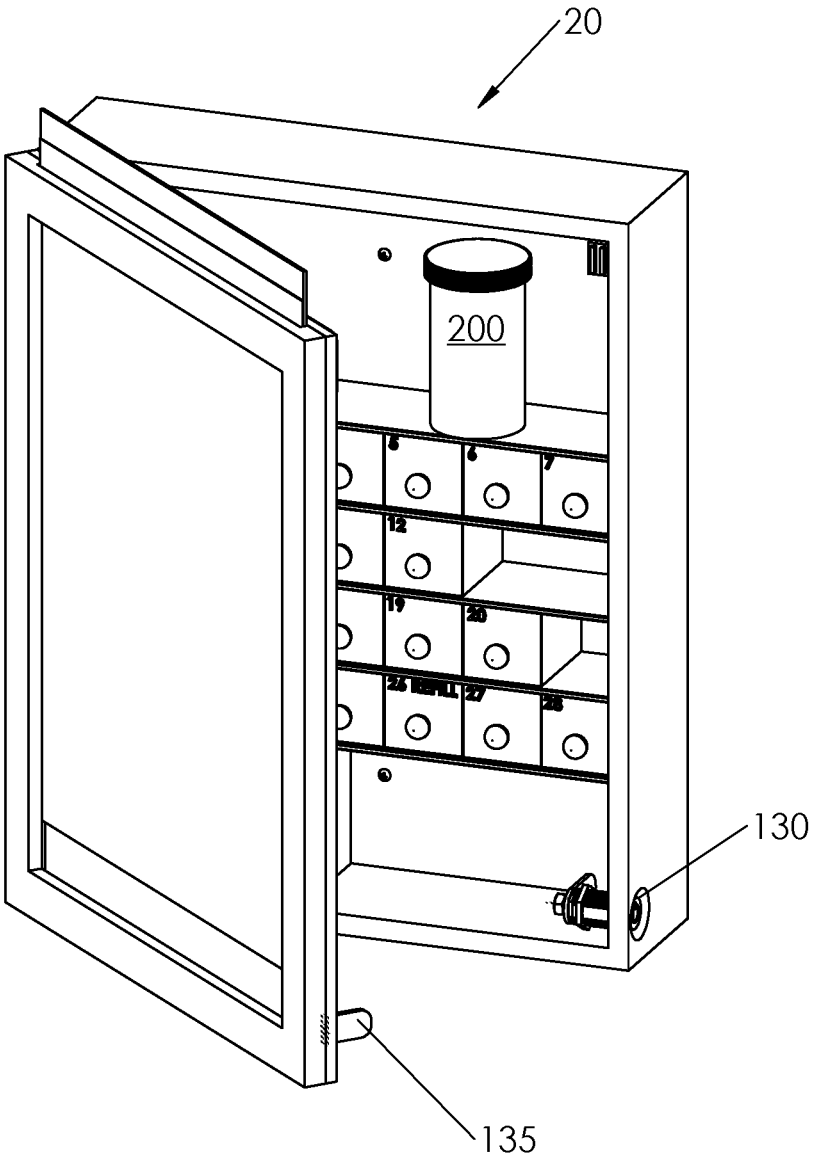
FIG. 4 is a front perspective view of the novel storage device of FIG. 1 and illustrating a plurality of drawers removed.

As best in FIG. 3, an inner wall 41 can also be provided and secured to the frame 30 in order to create a larger storage portion 44 for storing larger items, medicine bottles 200, syringes, thermometers, medical supplies, etc. A shorter shelve 50*a* is shown connected to inner wall 41 and a larger storage drawer 72 can also be provided. However, it is also within the scope of the disclosure to also provide one, two or three drawers 70 where larger 72 is shown or alternatively have no drawers disposed in that portion of storage area 42. FIG. 3 also illustrates a non-limiting configuration of the placement of shelves 50 and drawers 70 which also provides for a second larger storage portion 45 at the top of storage area 42. However, various configurations that permit for a sufficient number of drawers 70 can be used and all are considered within the scope of the disclosure.

Figure 6:
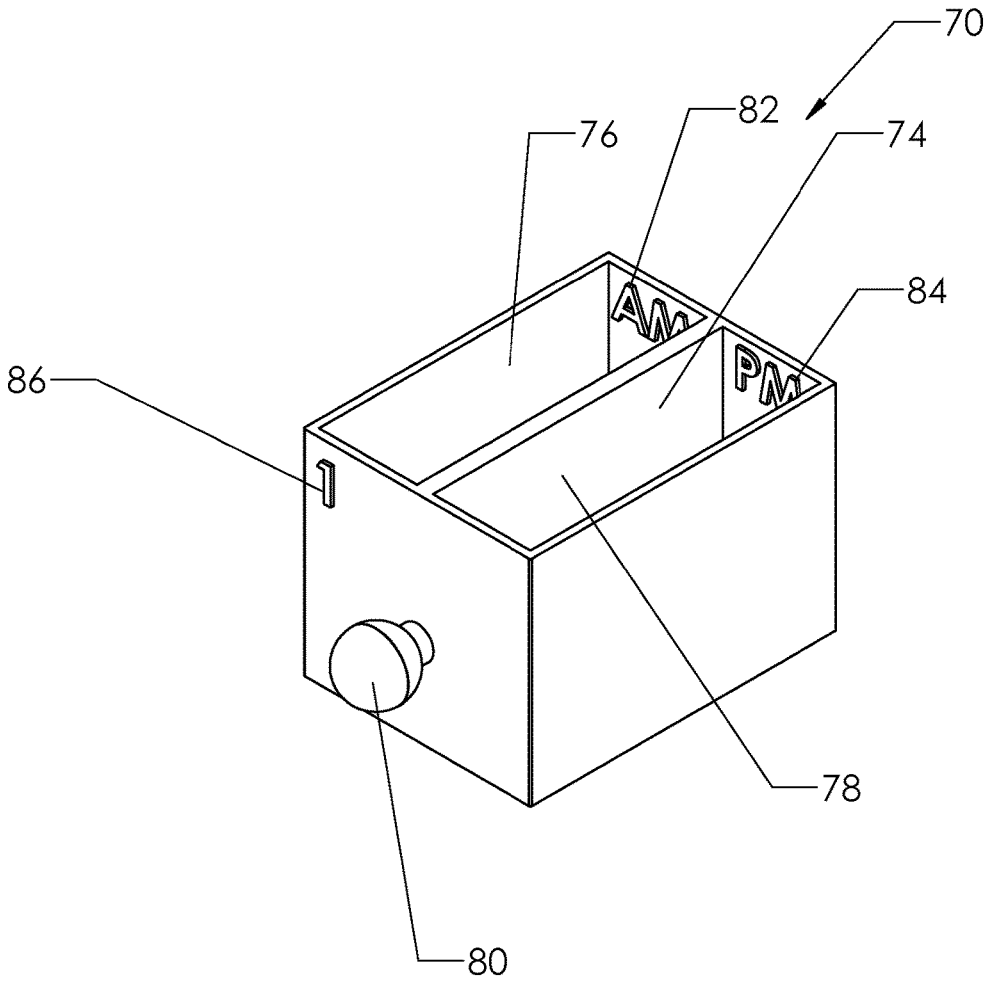
FIG. 6 is a perspective view of one non-limiting embodiment for a storage drawer for the novel storage device of FIG. 1.

As best seen in FIG. 6, each drawer 70 can be preferably provided with a divider 74 to create a first storage section 76 and a second storage section 78. As represented by indicia 82, section 76 can be used to store the medication that the user takes or needs for the morning ("AM"). Similarly, as represented by indicia 84, section 78 can be used to store the medication that the user takes or needs for the evening ("PM"). It also within the scope of the disclosure to use other indicia besides AM and PM, such as, but not limited to, "morning" and "evening", a sun image and a moon or quarter moon image, or a picture of clock showing 6:00 AM and 6:00 PM, etc. It is also within the scope of the disclosure to provide more than one divider 74 to further sectionalize each drawer 70. For example, by providing a divider running perpendicular to divider 74, two storage sections under AM and two storage sections under PM can be created. This will allow two users (i.e. husband and wife, etc.) to both be able to store and separate their medications for each day and time of day with one storage device 20. Furthermore, other daily needed items can also be separated and stored in the divided sections of drawers 70, such as, but not limited to, vitamins and other supplements.

A handle 80 can be provided for aiding in pulling drawer 70 out of its designed storage spot within storage area 42. Additionally, preferably at least thirty-one drawers 70 can be provided, such that there is one available for each day of the month. Each of such drawers 70 can be provided with a particular number 86 from "1" to "31". As seen in FIG. 6, the drawer 70 shown is numbered "1" which represents that the particular drawer 70 is used to store the medications needed or taken on the first day of the month. A particular drawer 70 can also be designated to serve a refill reminder. As seen in FIG. 3, the reminder 88 can be the words REFILL written on the front of the particular drawer 70. Preferably, the drawer 70 selected will be one closer towards the end of the month, though such is not considered limiting, and any drawer 70 can be used for having a refill reminder 88. Preferably, upon reaching drawer 70 with refill reminder at the specific date in the month, the user will be reminded to refill all of the drawers 70 that they have taken their medication out of, which should be the other drawers 70 used for the days of the month (i.e. drawers 70 having a reference number 86 on its front outer surface. Indicia 82, 84, 86 and 88 can be provided on the drawers 70 by any conventional method, such as, but not limited to, label, printing, etching, etc. Preferably, each drawer 70 is removable to fill and/or refill the drawers with medications or other medical and/or non-medical items.

A first portion 46 of a magnet connection is also seen in FIG. 3. Preferably, first portion 46 is located at the upper right corner of storage area 42. A second portion 47, which can be a metal strike plate, of the magnet connection is preferably attached to a back surface or back member of door/cover 100. When door 100 is in its closed position, first magnet portion 46 and second magnet portion 47 mate to help maintain and align door 100 in the proper closed position, prior to locking door 100 with lock 130 (discussed below). First magnet portion 46 can be secured to the inner surface of side wall 38 by any conventional attachment mechanism. Likewise, second magnet member/metal strike plate 47 can be secured to the back surface of door 100 by any conventional attachment mechanism.

Door 100 can be conventionally connected to side wall 36, such as, but not limited to, a hinged or pivot connection member. Door 100 can be provided with a front cutout 102 and top slot 104 and a back member 106. Additionally, an optional elongated groove can be provided adjacent to the bottom of cutout 102 for receipt of a bottom portion of decoration assembly 120 (discussed in more detail below).

Figure 7:
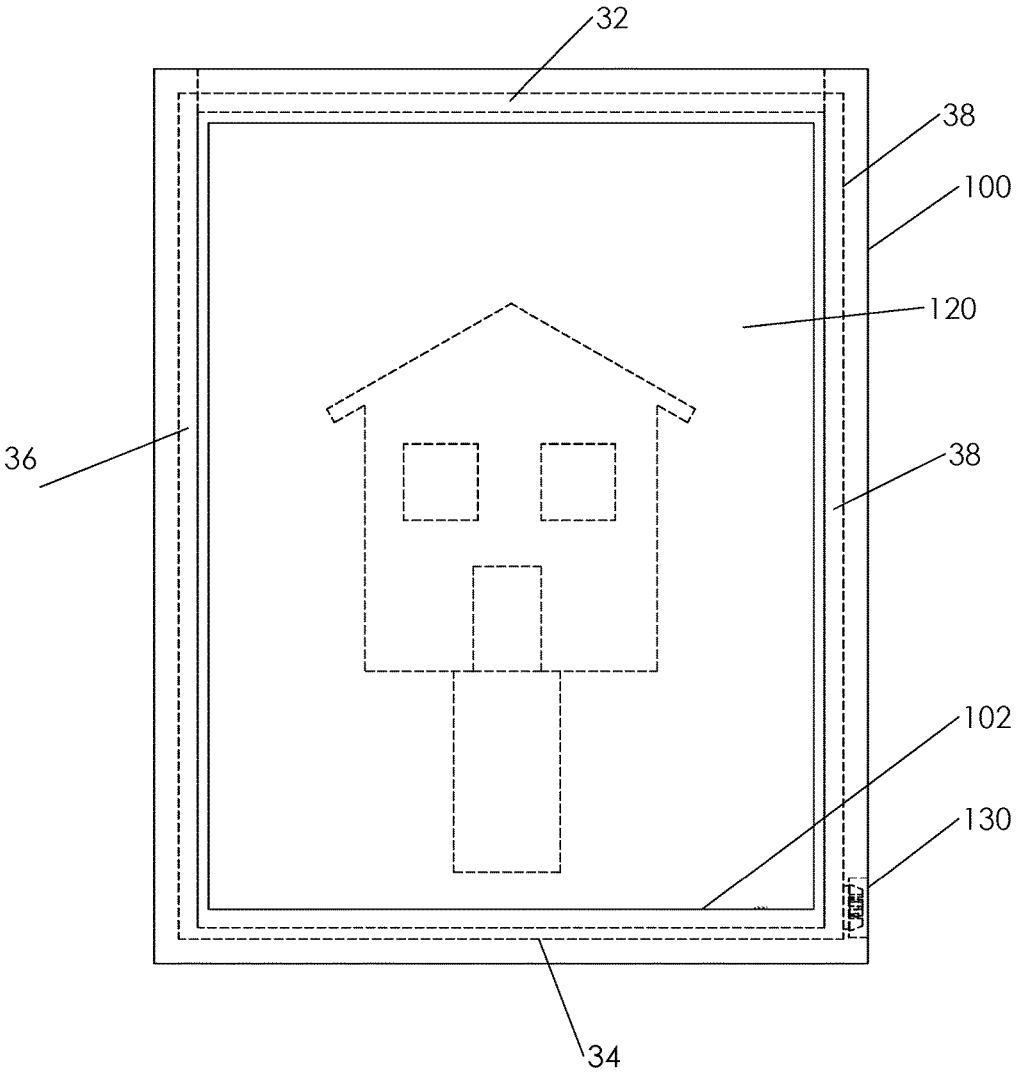
FIG. 7 is a front view of the novel storage device of FIG. 1.

A decorative or mirror assembly 120 can be provided and is preferably sized for top slot 104 and front cutout 102. Decorative or mirror assembly 120 preferably comprises either (1) an optional transparent/clear/translucent acrylic sheet 122 (such as, but not limited to, PLEXIGLASS), a decorative member 124 (such as, but not limited to, a photograph, drawing, painting, artwork, nostalgia flyer, etc.) and an optional backing 126, or (2) a mirror and an optional backing. Decorative or mirror assembly 120 is preferably inserted through top slot 104 and fills the area defined by front cutout 102. Where the elongated groove is provided, the bottom of decorative or mirror assembly 120 is received within the elongated groove. Optional acrylic sheet 122 provides protection to the decorative member 124 and optional backing 126 provides support for the decorative member. Thus, with decorative or mirror assembly 120 properly inserted and door 100 in a closed position, storage device 20 appears to be a painting, mirror, photograph, etc. hanging on the wall 101 of a room (See FIG. 7).

Figure 5:
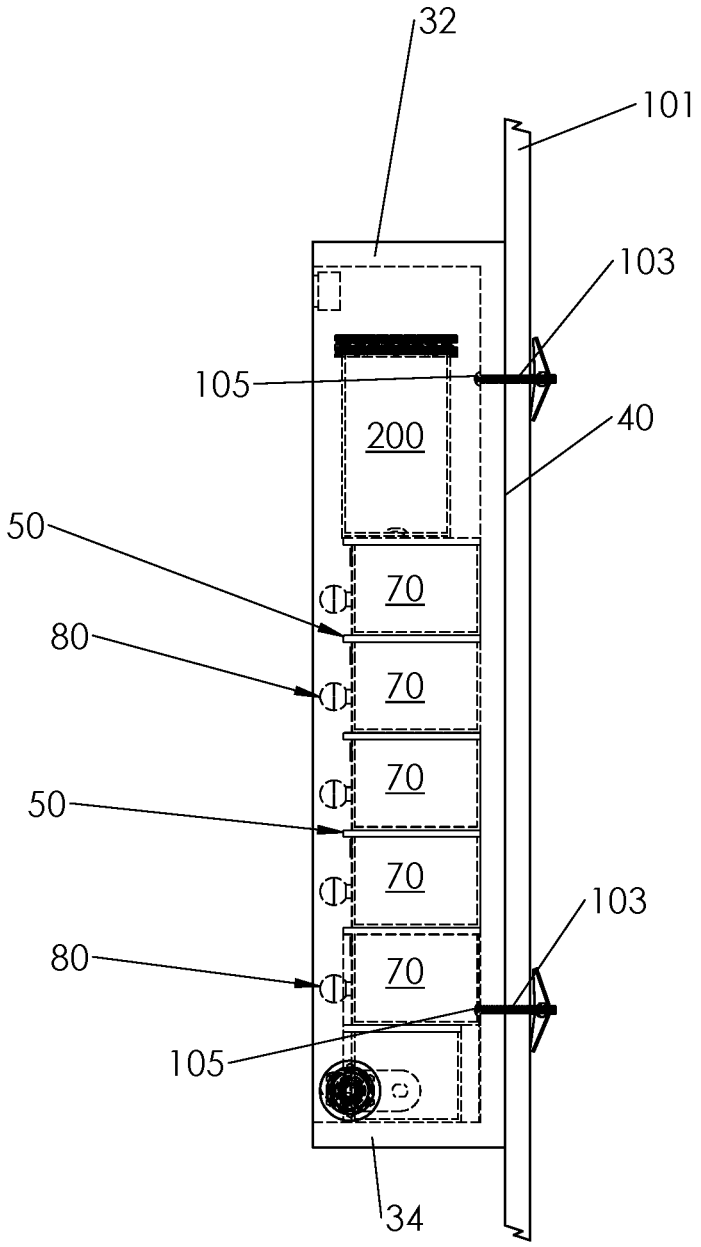
FIG. 5 is a side view of the novel storage device of FIG. 1 with the door removed and shown attached to a wall.

Storage device 20 can be secured to a wall 101 of a room by any conventional attachment mechanism. Preferably and as shown in FIG. 5, one or more toggle bolts 103 can be provided for securing storage device to wall 101. Access to the bolt heads 105 can be provide in larger storage portions 44 and 45 (See FIG. 3), such that, preferably, toggle bolts 103 do not interfere with the insertion and removal of drawers 70.

Figure 8:
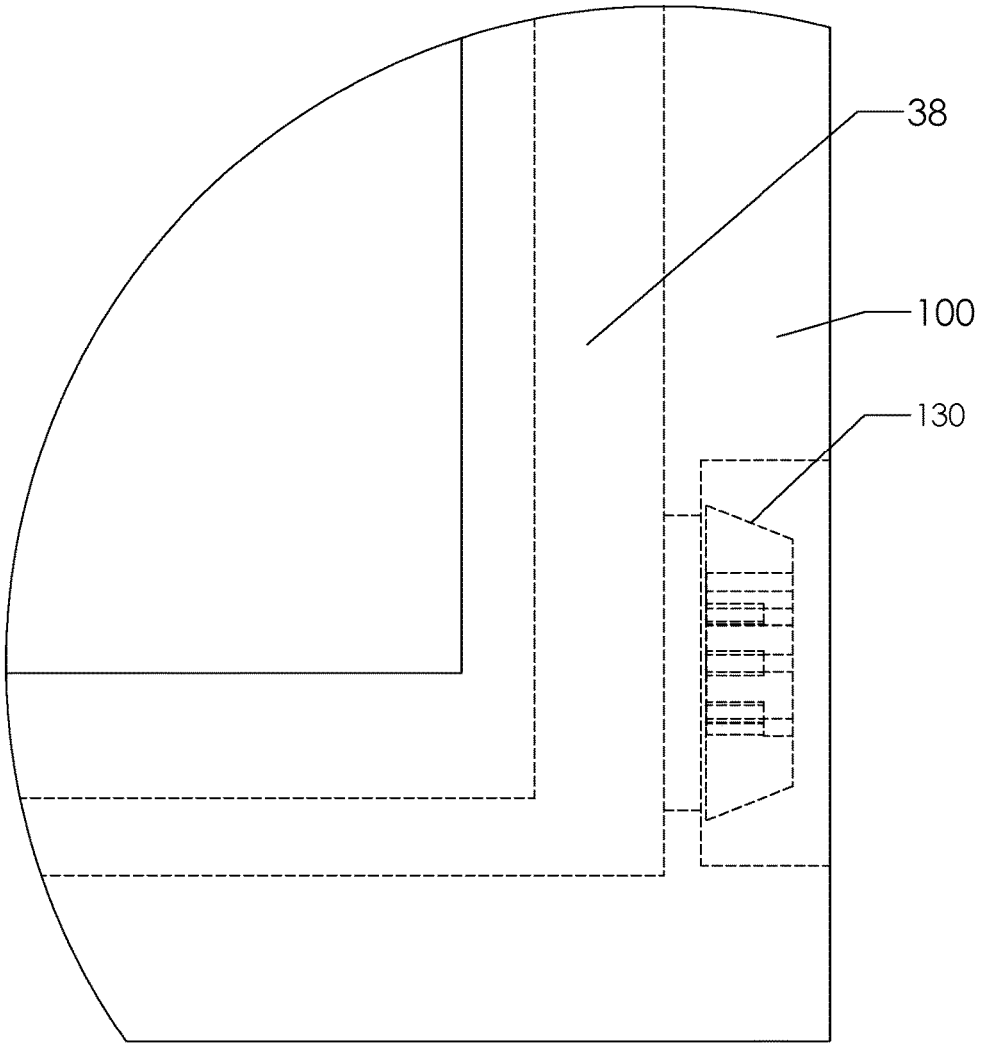
FIG. 8 is a bottom portion of the door for the novel storage device of FIG. 1 and illustrating the locking mechanism hidden behind the door from a front view (locking mechanism and frame border shown in dashed line to indicate that they are hidden)

When in the closed position (i.e. magnet 46 and magnet strike plate 47 mating), door 100 is properly aligned and can be locked (i.e. to frame/body 30) such that storage device 20 remains closed and cannot be opened. Accordingly, when storage device 20 is locked, the contents contained within storage area 42 is inaccessible to small children, thieves, visitors, etc. in the event they were aware that behind decorative assembly 120 was stored medication, valuables, etc. Various types of conventional locks can be used for lock 130. In one non-limiting embodiment, lock 130 can be lock operated by turning a key or entering a combination (i.e. cam lock, bolt lock, latch, etc. etc.), with the key hole/combination numbers 132 accessible on side wall 38 (preferably at the bottom) and behind door 100. The mating part/latch 135 of the lock can be secured to the back member of door 100. As best seen in FIG. 8 with lock 130 shown in dashed line, when viewing decorative element 120 from the front, lock 130 is hidden from view so not to alert a viewer of storage 42 and its contents. Door 100 is preferably taller and wider than frame/body 30 such that the entire frame/body 30 (top wall 32, bottom wall 34, side wall 36, side wall 38 and back wall 40) are hidden from view in the door 100 closed position when viewing from the front (See FIG. 7).

Accordingly, in use storage device 20, while storing and separating medications into their daily dosages (and preferably separating dosages for each day by morning and evening), appears to a viewer to be an ordinary mirror, painting, artwork, photograph, etc. hanging on a wall 101 of a dwelling/building. Though not considered limiting, preferably wall 101 is not one of the walls of a bathroom or restroom of the dwelling/building. When closed, preferably the user will lock door 100 in place using lock 130 to prevent unauthorized individuals from accessing storage device. Thus, in the addition to the convenience to the user of having his or her medications laid out or separated for an entire month in one easily accessible location, use of storage device 20 to store medications helps to reduce unauthorized ingestion of the medications and possible overdose by small children or teens and also helps to reduce robbery and theft of medications. Kitchen and bathroom counter can also be free from plastic or other pill containers and medication bottles.

Storage device 20 and its various parts described above are not considered limited to any particular dimensions. In non-limiting embodiment, frame/body 30 can be approximately 16.5 inches high, approximately 13.15 inches in width and approximately 3.5 inches in depth. Walls 32, 24, 36, 38 and/or 40 can be approximately 0.45 inches in thickness. Drawer 70 can be approximately, 1.75 inches in width, approximately 1.65 inches in height and approximately 2.34 inches in depth.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

All components and parts of the described hidden storage device and their locations, pivot mechanisms, attachment or securement mechanisms, locking mechanisms, dimensions, values, materials, shapes, etc. discussed above or shown in the drawings, if any, are merely by way of example and are not considered limiting and other component(s) and their locations, pivot mechanisms, attachment or securement mechanisms, locking mechanisms, dimensions, values, materials, shapes, etc. can be chosen and used and all are considered within the scope of the disclosure.

All indicia appearing on the hidden storage device can be in lower case and/or upper case letters and can be in a non-English language and all are considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

The benefits, advantages, solutions to problems, and any element(s) that may cause any benefit, advantage, or solution to occur or become more pronounced are not to be construed as a critical, required, or essential features or elements of any or all the claims.

While the hidden storage device has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein.

Thus, a wide variety of alternatives, suggested by the teachings herein, can be practiced without departing from the spirit of the disclosure, and rights to such alternatives are particularly reserved and considered within the scope of the disclosure.

What is claimed is:

1. A hidden storage device, comprising:

a frame defining a storage area, the frame adapted for securement to a wall of a dwelling or building, the frame including a first side wall, a second side wall, a bottom wall and a top wall;

a plurality of shelves secured to the frame and disposed within the storage area;

a plurality of removable drawers, each of the plurality of drawers positioned on one of the plurality of shelves or at a bottom internal surface of the frame, each of the plurality of drawers having a front member, a first side member, a second side member, a back member and a bottom member that collectively define a medication storage area for the drawer, each of the plurality of drawers having a divider member disposed within the medication storage area that extends from the front member to the back member to divide the medication storage area into a first undivided medication storage portion extending from the front member to the back member and a second undivided medication storage portion extending from the front member to the back member, the back member having an internal wall that is divided by the divider member into a first internal back wall section associated with the first undivided medication storage portion and a second internal back wall section associated with the second undivided medication storage portion;

a door pivotally secured to the frame, when in a closed position the door prevents access to the storage area; and a decorative element or mirror secured to an external side of the door such that when the door is in a closed position and the frame is secured to the wall the frame is hidden behind the decorative element or mirror when viewing the hidden storage device from a straight on view;

wherein the first internal back wall section of the back member internal wall contains first indicia representing a morning time or period and the second internal back wall section of the back member internal wall contains second indicia representing an evening time or period, wherein the first indicia and the second indicia are located on a same back member but separate wall sections of the back member.

2. The hidden storage device of claim 1 wherein the plurality of removable drawers comprises at least 31 drawers, wherein 31 drawers of the plurality of removable drawers each having a number between 1 and 31 disposed on an outer front surface of the front member of the drawer, wherein a number selected for a specific drawer of the 31 drawers is different from all other numbers selected for the other drawers of the 31 drawers so that each whole number between 1 and 31 is represented; wherein the drawers are positioned and stored consecutively within the storage area by the numbers appearing on the front outer surface.

3. The hidden storage device of claim 1 wherein one of the drawers having a number on an outer surface of the front member also having text meaning REFILL disposed on the outer surface of the front member to remind the user to refill the drawers with medication.

4. The hidden storage device of claim 1 wherein the first indicia is the letters AM and the second indicia is the letters PM.

5. The hidden storage device of claim 1 further comprising a lock having a first portion secured to the frame and a second portion secured to the door, the lock externally accessible to a user through one of the walls of the frame at all times including when the door is in a closed position with respect to the frame, when activated or engaged the lock locking the door to the frame and preventing the door from being opened until the lock is deactivated or disengaged.

6. The hidden storage device of claim 1 wherein the door having a top member having a slot and the decorative element or mirror is removably secured to the external side of the door by inserting the decorative element or mirror through the slot of the top member.

7. The hidden storage device of claim 1 further comprising a magnet member disposed within the storage area and secured to an inner wall of the frame and a strike plate secured to the back of the door, the magnet member mating with the strike plate when the door is in a closed position.

8. The hidden storage device of claim 1 wherein each of the plurality of drawers having a knob secured to and extending outward from an external surface of the front member of the drawer for pulling the drawer out of its inserted position within the storage area.

9. A hidden storage device, comprising:

a frame defining a storage area, the frame adapted for securement to a wall of a dwelling or building, the frame including a first side wall, a second side wall, a bottom wall and a top wall;

a plurality of shelves secured to the frame and disposed within the storage area;

at least thirty-one removable drawers, each of the plurality of drawers having a front member, a first side member, a second side member, a back member and a bottom member that collectively define a medication storage area for the drawer, each of the plurality of drawers having a divider member disposed within the medication storage area that extends from the front member to the back member to divide the medication storage area into a first undivided medication storage portion extending from the front member to the back member and a second undivided medication storage portion extending from the front member to the back member, the back member having an internal wall that is divided by the diver member into a first internal back wall section associated with the first undivided medication storage portion and a second internal back wall section associated with the second undivided medication storage portion, each of the at least thirty-one removable drawers positioned on one of the plurality of shelves or at a bottom internal surface of the frame; wherein thirty-one specific drawers of the at least thirty-one removable drawers each having a number between 1 and 31 disposed on an outer front surface of the front member of the drawer, wherein a number selected for a drawer of the thirty-one specific drawers is different from all other numbers selected for the other drawers of the thirty-one specific drawers so that each whole number between 1 and 31 is represented; wherein the thirty-one specific drawers are positioned and stored consecutively within the storage area by the numbers appearing on the front outer surface;

a door pivotally secured to the frame, when in a closed position the door prevents access to the storage area;

a decorative element secured to an external side of the door such that when the door is in a closed position and the frame is secured to the wall the frame is hidden behind the decorative element when viewing the hidden storage device from a straight on view; and a lock having a first portion secured to the frame and a second portion secured to the door, the lock externally accessible to a user through one of the walls of the frame at all times including when the door is in a closed position with respect to the frame, when activated or engaged the lock locking the door to the frame and preventing the door from being opened until the lock is deactivated or disengaged;

wherein the first internal back wall section of the back member internal wall contains first indicia representing a morning time or period and the second internal back wall section of the back member internal wall contains second indicia representing an evening time or period, wherein the first indicia and the second indicia are located on a same back member but separate wall sections of the back member.

10. The hidden storage device of claim 9 wherein one of the drawers having a number on an outer surface of the front member also having further indicia disposed on the outer surface of the front member to remind the user to refill the drawers with medication.

11. The hidden storage device of claim 9 wherein the first indicia is the letters AM and the second indicia is the letters PM.

12. The hidden storage device of claim 9 wherein the door having a top member having a slot and the decorative element is removably secured to the external side of the door by inserting the decorative element or mirror through the slot of the top member.

13. The hidden storage device of claim 9 further comprising a magnet member disposed within the storage area and secured to an inner wall of the frame and a strike plate secured to the back of the door, the magnet member mating with the strike plate when the door is in a closed position.

14. The hidden storage device of claim 9 wherein each of the plurality of drawers having a knob secured to and extending outward from an external surface of the front member of the drawer for pulling the drawer out of its inserted position within the storage area.

15. A hidden storage device, comprising:

a frame defining a storage area, the frame adapted for securement to a wall of a dwelling or building in an embossed orientation, the frame including a first side wall, a second side wall, a bottom wall and a top wall;

a plurality of shelves secured to the frame and disposed within the storage area;

at least thirty-one removable drawers, each of the plurality of drawers having a front member, a first side member, a second side member, a back member and a bottom member that collectively define a medication storage area for the drawer, each of the plurality of drawers having a divider member disposed within the medication storage area that extends from the front member to the back member to divide the medication storage area into a first undivided medication storage portion extending from the front member to the back member and a second undivided medication storage portion extending from the front member to the back member, the back member having an internal wall that is divided by the divider member into a first internal back wall section associated with the first undivided medication storage portion and a second internal back wall section associated with the second undivided medication storage portion, each of the at least thirty-one removable drawers positioned on one of the plurality of shelves or at a bottom internal surface of the frame; each of the plurality of drawers having a knob secured to and extending outward from an external surface of the front member of the drawer for pulling the drawer out of its inserted position within the storage area; wherein thirty-one specific drawers of the at least thirty-one removable drawers each having a number between 1 and 31 disposed on an outer front surface of the front member of the drawer, wherein a number selected for a drawer of the thirty-one specific drawers is different from all other numbers selected for the other drawers of the thirty-one specific drawers so that each whole number between 1 and 31 is represented; wherein the thirty-one specific drawers are positioned and stored consecutively within the storage area by the numbers appearing on the front outer surface, wherein the first internal back wall section of the back member internal wall contains first indicia representing a morning time or period and the second internal back wall section of the back member internal wall contains second indicia representing an evening time or period, wherein the first indicia and the second indicia are located on a same back member but separate wall sections of the back member;

a door pivotally secured to the frame, when in a closed position the door prevents access to the storage area;

a decorative element secured to an external side of the door such that when the door is in a closed position and the frame is secured to the wall the frame is hidden behind the decorative element when viewing the hidden storage device from a straight on view;

a lock having a first portion secured to the frame and a second portion secured to the door, the lock externally accessible to a user through one of the walls of the frame at all times including when the door is in a closed position with respect to the frame, when activated or engaged the lock locking the door to the frame and preventing the door from being opened until the lock is deactivated or disengaged;

a magnet member disposed within the storage area and secured to an inner wall of the frame; and a strike plate secured to the back of the door, the magnet member mating with the strike plate when the door is in a closed position.

16. The hidden storage device of claim 15 wherein the first indicia is the letters AM and the second indicia is the letters PM.

17. The hidden storage device of claim 15 wherein the door having a top member having a slot and the decorative element is removably secured to the external side of the door by inserting the decorative element through the slot of the top member.

18. The hidden storage device of claim 17 wherein one of the drawers having a number on an outer surface of the front member also having text meaning REFILL disposed on the outer surface of the front member to remind the user to refill the drawers with medication.

* * * * *